US011673698B2

(12) United States Patent
Lebel et al.

(10) Patent No.: US 11,673,698 B2
(45) Date of Patent: Jun. 13, 2023

(54) CONTINUOUS MOTION FILLING SYSTEM AND FILLING MACHINE AND METHODS

(71) Applicant: Blue Sky Ventures (Ontario) Inc., Toronto (CA)

(72) Inventors: Alexandre Lebel, Laval (CA); Simon Lajoie, Montréal (CA); Mathieu Lafortune, Mascouche (CA)

(73) Assignee: BLUE SKY VENTURES (ONTARIO) INC., Toronto (CA)

( * ) Notice: Subject to any disclaimer, the term of this patent is extended or adjusted under 35 U.S.C. 154(b) by 173 days.

(21) Appl. No.: 17/194,926

(22) Filed: Mar. 8, 2021

(65) Prior Publication Data

US 2021/0284373 A1 Sep. 16, 2021

Related U.S. Application Data

(60) Provisional application No. 62/987,555, filed on Mar. 10, 2020.

(51) Int. Cl.

| | |
|---|---|
| ***B65B 43/52*** | (2006.01) |
| ***B65B 57/06*** | (2006.01) |
| ***B65B 5/10*** | (2006.01) |
| ***B65B 57/14*** | (2006.01) |
| ***B65B 35/06*** | (2006.01) |

(52) U.S. Cl.

CPC ..... *B65B 43/52* (2013.01); *B65B 5/101* (2013.01); *B65B 57/06* (2013.01); *B65B 57/14* (2013.01); *B65B 5/103* (2013.01); *B65B 35/06* (2013.01)

(58) Field of Classification Search

CPC ..... B65B 43/52; B65B 5/101; B65B 57/06; B65B 57/14; B65B 5/103; B65B 35/06; B65B 57/20; B65B 39/00

See application file for complete search history.

(56) References Cited

U.S. PATENT DOCUMENTS

| | | | | | |
|---|---|---|---|---|---|
| 3,045,720 | A | * | 7/1962 | Jungmayr | B65B 39/14 222/536 |
| 3,152,622 | A | * | 10/1964 | Rothermel | B65B 39/14 141/181 |
| 3,217,760 | A | * | 11/1965 | Eisenberg | B65B 1/10 141/89 |
| 3,828,918 | A | * | 8/1974 | Talbat | B65B 23/12 198/418.6 |

(Continued)

FOREIGN PATENT DOCUMENTS

| | | |
|---|---|---|
| CA | 2754274 | 3/2013 |
| EP | 798262 | 10/1997 |

(Continued)

*Primary Examiner* — Thomas M Wittenschlaeger
*Assistant Examiner* — Katie L Gerth
(74) *Attorney, Agent, or Firm* — Thompson Hine LLP

(57) ABSTRACT

A filling system includes a conveyor for moving containers to be filled along a conveyance path and a drop chute with an outlet above the conveyance path. A drive for the drop chute includes a primary drive frame movable along a first axis and a secondary drive frame mounted on the primary drive frame for movement therewith, the secondary drive frame movable relative to the primary drive frame along a second axis, wherein the second axis is transverse to the first axis. A filling machine with a rotating disc assembly is also provided.

23 Claims, 24 Drawing Sheets

(56) References Cited

U.S. PATENT DOCUMENTS

| | | | | | |
|---|---|---|---|---|---|
| 4,226,073 | A * | 10/1980 | Rose | B65B 5/101 | 53/247 |
| 4,353,198 | A * | 10/1982 | Koppe | B65B 43/465 | 53/570 |
| 4,385,670 | A * | 5/1983 | Braun | G01G 15/02 | 177/1 |
| 4,674,259 | A * | 6/1987 | Hills | B65B 39/007 | 53/247 |
| 6,079,191 | A * | 6/2000 | Borkiewicz | B65B 19/34 | 53/247 |
| 6,185,901 | B1 * | 2/2001 | Aylward | B65B 57/14 | 53/244 |
| 6,481,180 | B1 * | 11/2002 | Takahashi | B65B 37/08 | 53/238 |
| 6,701,973 | B2 * | 3/2004 | Ikemoto | B65B 39/14 | 141/10 |
| 6,755,223 | B1 | 6/2004 | Trebbi | | |
| 6,799,413 | B2 | 10/2004 | Aylward | | |
| 7,255,247 | B2 | 8/2007 | Aylward | | |
| 7,322,170 | B2 | 1/2008 | Tomalesky | | |
| 7,909,158 | B2 | 3/2011 | Noe | | |
| 9,199,748 | B2 * | 12/2015 | Cremer | B65B 43/50 | |
| 9,399,532 | B2 | 7/2016 | Noe | | |
| 9,493,254 | B2 | 11/2016 | Boira Bonhora | | |
| 9,862,585 | B2 | 1/2018 | Ramnarain | | |
| 10,513,356 | B2 | 12/2019 | Monti | | |
| 10,640,288 | B2 | 5/2020 | Lucas | | |
| 10,926,901 | B2 * | 2/2021 | Kim | B65B 35/44 | |
| 11,155,378 | B2 * | 10/2021 | Savoie-Lavigueur | B65B 1/06 | |
| 2006/0086065 | A1 | 4/2006 | Tomalesky | | |
| 2006/0163271 | A1 * | 7/2006 | Hatsuno | B65B 5/103 | 700/240 |
| 2015/0120039 | A1 | 4/2015 | Nishibue | | |
| 2019/0322451 | A1 * | 10/2019 | Bastian, II | B65B 11/008 | |
| 2019/0329921 | A1 | 10/2019 | Thomas | | |
| 2021/0284366 | A1 * | 9/2021 | Lebel | B65B 35/40 | |

FOREIGN PATENT DOCUMENTS

| | | |
|---|---|---|
| EP | 1390261 | 2/2004 |
| EP | 1831076 | 9/2007 |
| EP | 1942065 | 7/2008 |
| EP | 2974970 | 1/2016 |
| EP | 3303154 | 4/2018 |
| EP | 3434606 | 1/2019 |

* cited by examiner

CONTINUOUS MOTION FILLING SYSTEM AND FILLING MACHINE AND METHODS

TECHNICAL FIELD

This application relates generally to filling systems for items and, more specifically, to a continuous motion filling system of a type that may be used in filling machines in which items are being conveyed, checked, counted and grouped for purposes of filling containers or packages with a set number of the items.

BACKGROUND

In the packaging of bulk items, such as pharmaceutical tablets or capsules, the items must be counted and grouped in order to fill containers, packages or other receptacles with a desired number of the items. Speed of container filling is a critical factor in such machines, as is machine cleanliness or cleanability.

Accordingly, an improved continuous motion filling system for use in filling machines would be desirable.

SUMMARY

In one aspect, a filling system includes a conveyor for moving containers to be filled along a conveyance path; at least one drop chute with an outlet above the conveyance path; a drive train operatively connected for moving the drop chute to align the outlet of the drop chute with one container of the moving containers during filling of the one container with items, the drive assembly comprising: a primary drive frame movable along a first axis; a secondary drive frame mounted on the primary drive frame for movement therewith, the secondary drive frame movable relative to the primary drive frame along a second axis, wherein the second axis is transverse to the first axis, wherein the secondary drive frame includes a drive link operatively linked to move the drop chute.

In another aspect, a filling machine includes a housing at least in part defining an internal space, the housing including a rotating disc assembly positioned in an opening of a housing wall; a conveyor for moving containers to be filled along a conveyance path at an external side of the housing; at least one drop chute with an outlet above the conveyance path; a drive assembly operatively connected for moving the drop chute to align the outlet of the drop chute with one container of the moving containers during filling of the one container with items, the drive assembly including a drive link movable both substantially parallel to the conveyance path and runs substantially perpendicular to the conveyance path, at least part of the drive link located within the internal space; wherein the drive link is operatively connected to move the drop chute through the rotating disc assembly.

In yet another aspect, a filling system includes a conveyor for moving containers to be filled along a conveyance path; at least one drop chute with an outlet above the conveyance path; a drive assembly operatively connected for moving the drop chute to align the outlet of the drop chute with one of the moving containers during filling of the one container with items. The drive assembly includes: a primary drive frame laterally movable along a first axis; a secondary drive frame mounted on the primary drive frame for movement therewith, the secondary drive frame movable relative to the primary drive frame along a second axis, wherein the second axis is perpendicular to the first axis, wherein the secondary drive frame includes a drive link operatively linked to move the drop chute; a first motor connected to drive a first pulley or sprocket; a second motor connected to drive a second pulley or sprocket; a common belt or chain traversing a path that runs partially around the first pulley or sprocket and partially around the second pulley or sprocket.

In still another aspect, a filling machine includes a housing at least in part defining a sealed internal space, the housing including a rotating disc assembly positioned in an opening of a housing wall; a conveyor for moving containers to be filled along a conveyance path at an external side of the housing; at least one drop chute with an outlet above the conveyance path; and a drive assembly operatively connected for moving the drop chute to align the outlet of the drop chute with one of the moving containers during filling of the one container with items. The drive assembly includes a drive link movable along both a first path that runs substantially parallel to the conveyance path and a second path the runs substantially perpendicular to the conveyance path, at least part of the drive link located within the internal space. The drive link is operatively connected to move the drop chute through the rotating disc assembly.

The details of one or more embodiments are set forth in the accompanying drawings and the description below. Other features, items, and advantages will be apparent from the description and drawings, and from the claims.

BRIEF DESCRIPTION OF THE DRAWINGS

FIGS. 5 and 6 are partial perspectives of portions of the filling machine;

DETAILED DESCRIPTION

Figure 1:
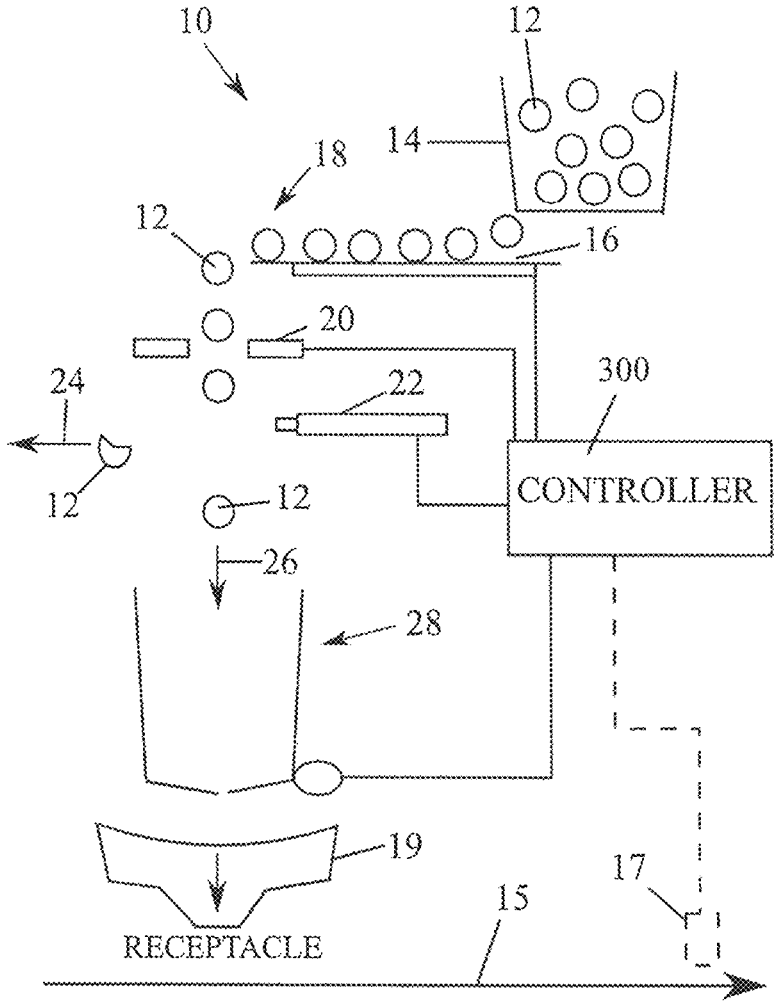
FIG. 1 is schematic depiction of a filling machine.
Figure 2:
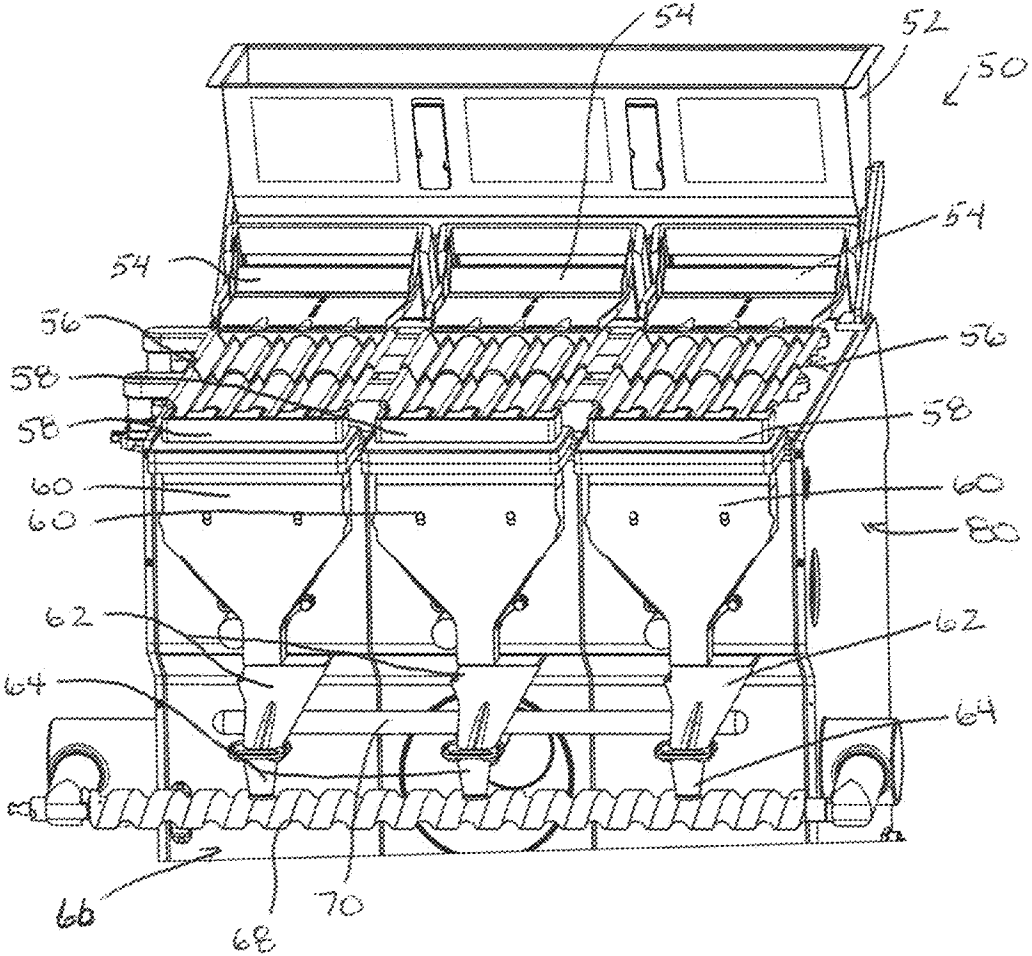
FIG. 2 is a perspective view of an exemplary filling machine.
Figure 3:
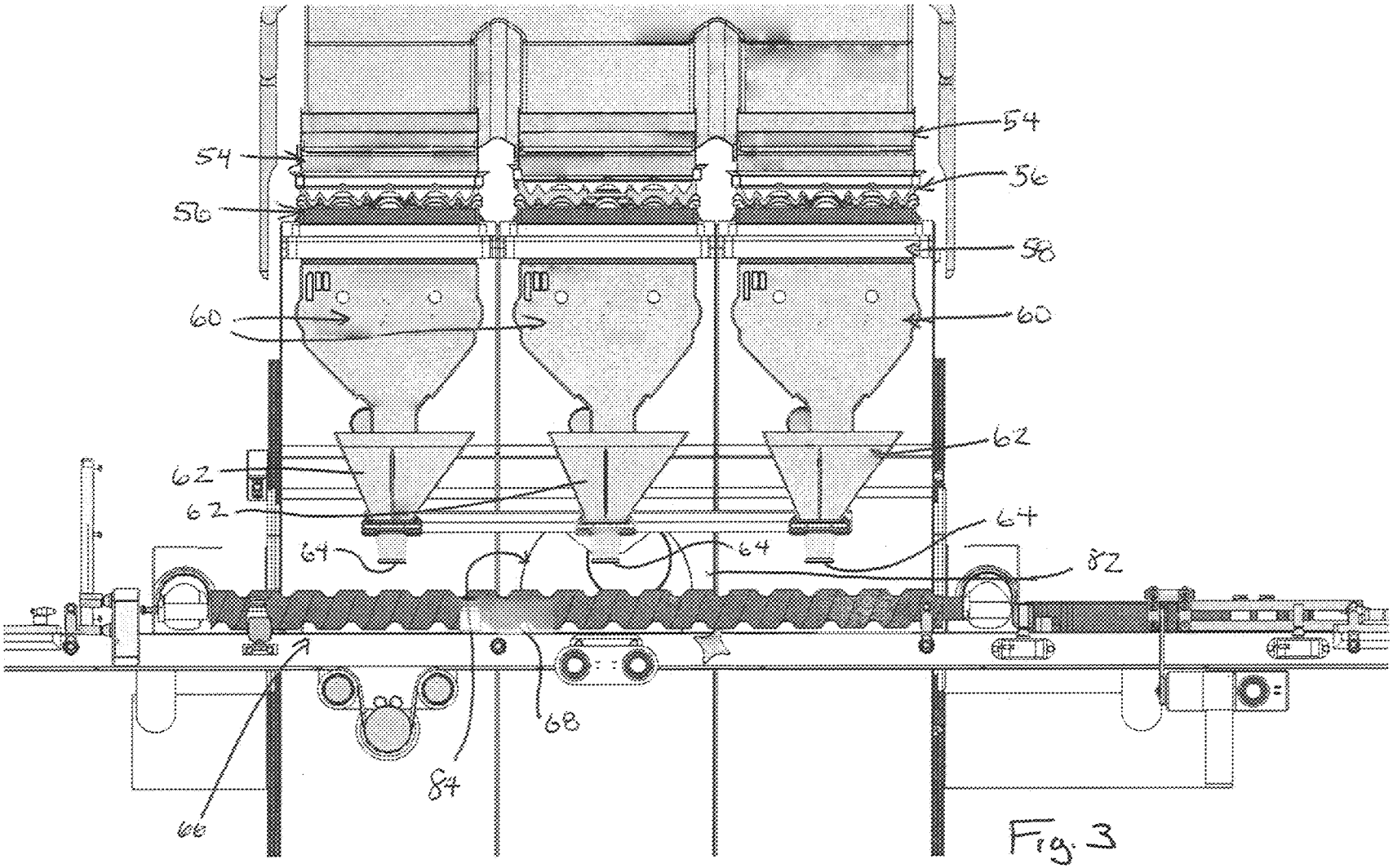
FIG. 3 is a partial front elevation of the filling machine.
Figure 4:
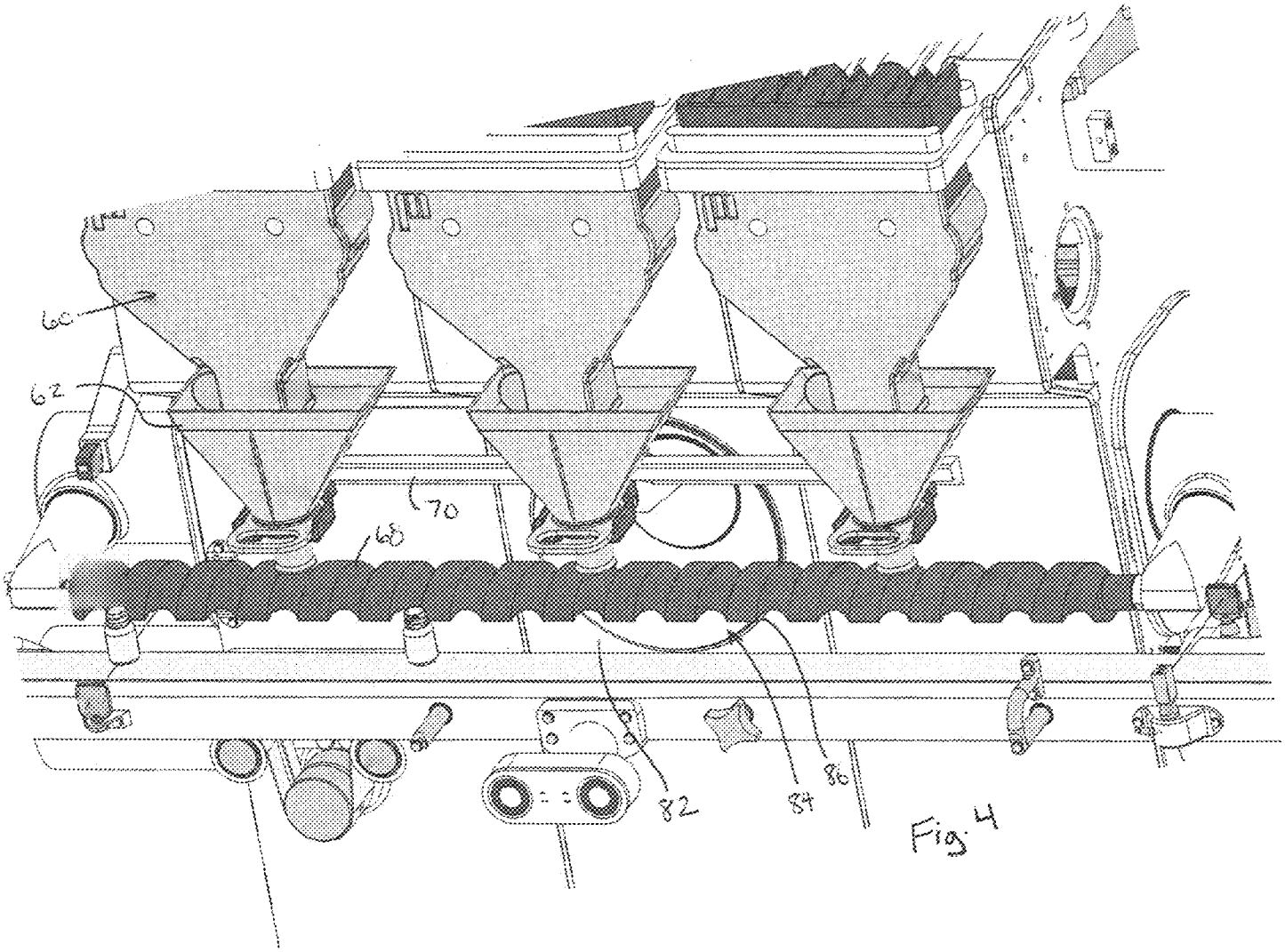
FIG. 4 is a partial perspective of the filling machine.
Figure 15:
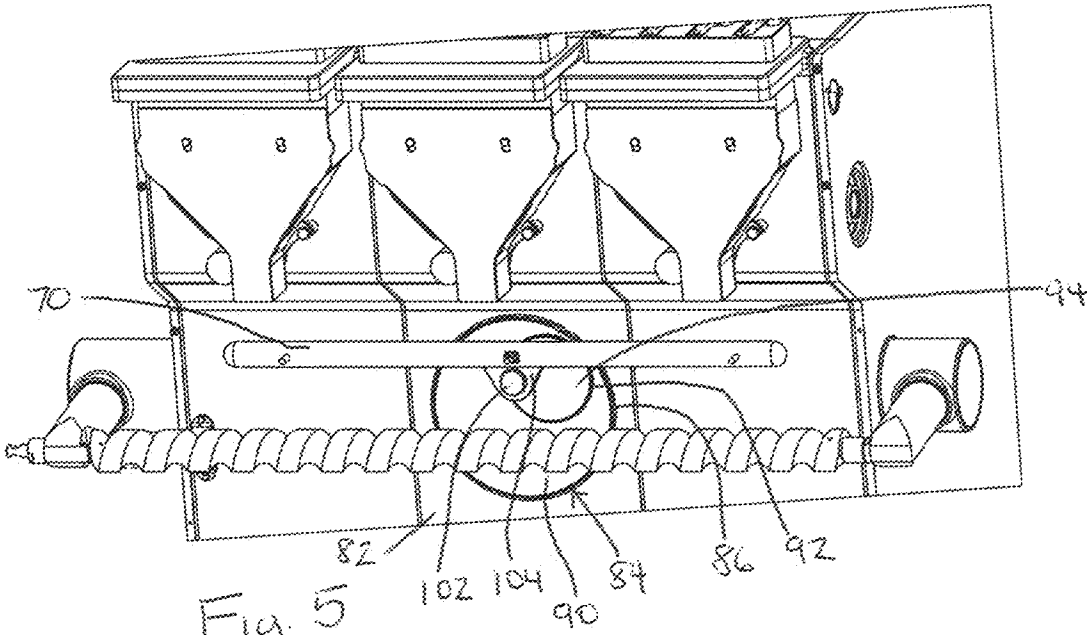
FIGS. 15A-15P show one exemplary filling sequence for one embodiment of a filling machine.
Figure 6:
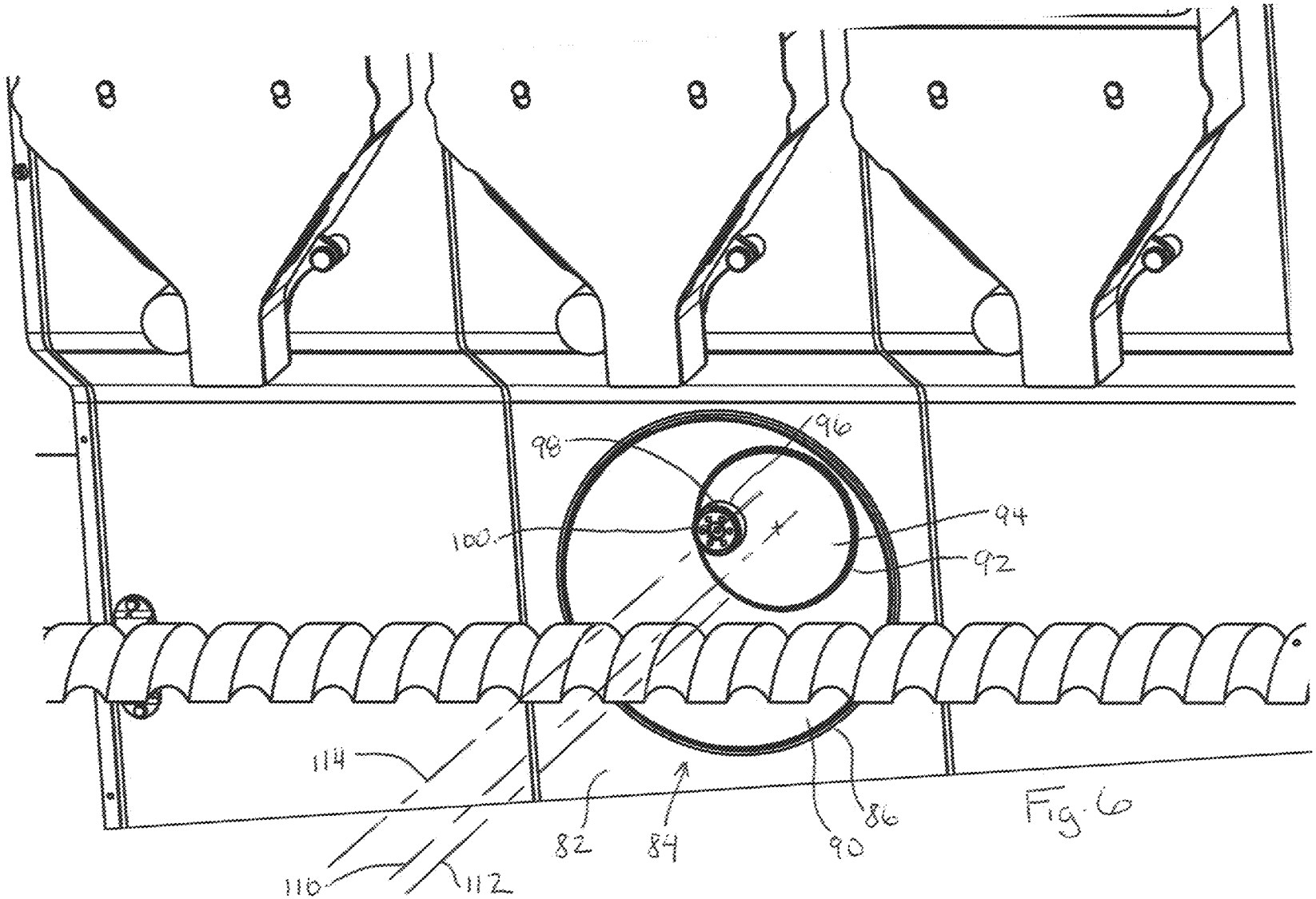

FIG. 1 shows a schematic depiction of a filling device 10 for conveying, counting and analyzing items 12 and feeding the items 12 to a container, package or other receptacle. By way of example, the items may be solid dose tablets, gelcaps or capsules (e.g., of the pharmaceutical variety) and the filling device may be either intermittent or continuous type. The device 10 includes a bulk feeder 14 that deposits the items 12 to a conveyor 16, which aligns, singulates and spaces the items as they are moved to a drop point 18. The conveyor 16 may, for example, be a vibratory conveyor mechanism, as described in more detail below. As the items 12 fall along an item fall path (e.g., under gravity) they pass a sensor system 20, which counts the items as they pass so that an accurate and controlled fill count can be achieved. The sensor system 20 also analyzes the items for defects. In some cases, a reject mechanism 22 may be provided to move defective items to a reject path 24. For example, in the case of solid dose tablets, chipped tablets such as tablet 12' can be rejected. The reject mechanism could, for example, be a pressurized air unit the delivers a burst of pressurized air to move a defective item out of the item fall path and into the reject path 24. The reject mechanism could alternatively be a flap mechanism selectively movable into the item fall path to divert the item out of the item fall path by contact with the flap mechanism. In other implementations, item reject could occur further downstream in a system (e.g., by using a downstream reject mechanism 17 to move a receptacle containing a defective tablet out of the flow of a receptacle conveyance path 15 after the defective tablet is filled into the receptacle). Items 12 that are not rejected follow the fill path 26. A gate system 28 along the fill path 26 may be controlled as desired to achieve delivery of an appropriate item count to a drop chute 19 that feeds receptacles. In a typical filling device, the conveyor 16 may align the items 12 into multiple feed paths that feed the items to multiple drop points, each with a respective sensor system 20, reject mechanism 22 and gating system 28. A controller 300 may be configured to control the various system components, including a conveyor that moves the items along the path 15 and movement of the drop chute 19, as explained in more detail below.

Referring now to FIGS. 2-6, one embodiment of a filling machine 50 is shown, which includes a single hopper 52 with three outfeed sections 54 that feed to three respective vibratory conveyors 56. Each conveyor conveys items to a respective item sense/count section 58 and gating section 60. Each gating section includes an outlet that feeds into a respective drop chute 62 with a lower outlet opening 64. The drop chute outlet openings 64 are positioned above a conveyor 66 that moves containers along a conveyance path beneath the drop chute openings, so that items can be dropped into containers moving along the conveyance path. Here, a belt conveyor transports containers, and a rotating feed screw 68 spaces apart the containers to provide a predetermined or desired container pitch.

The drop chutes 62 are all connected to a common beam 70, such that movement of the beam 70 causes movement of all of the drop chutes 62 in a synchronous manner. The beam 70 can be moved both left and right (laterally or horizontally, substantially parallel with the conveyance path) and up and down (vertically, substantially perpendicular to the conveyance path). This type of controlled movement of a component using a beam may be referred to as a "walking beam" configuration. Although three drop chutes are shown connected to a common beam 70, a given machine could include less drop chutes (e.g., one or two) or more drop chutes (e.g., four, five or more).

Of particular interest in the filling machine or filling system of the present application is the drive arrangement for moving the beam 70. In particular, for cleanability reasons such as those desired in pharmaceutical packaging or similar environments, preventing collection of material (e.g., particulate or fines from pills) on difficult to clean parts of the machine, such as the drive assembly for the beam, is desired. For this reason, a drive assembly, or majority thereof, for the walking beam 70 may be sealingly contained within an internal space of a housing 80 of the machine. Here, the housing 80 includes a plurality of walls, including a front wall or conveyor facing wall 82 and a rotating disc assembly 84 positioned in an opening 86 of the wall 82. A drive assembly operatively (not shown in FIGS. 2-6), which is connected for moving the drop chute(s) 62 (e.g., via the beam 70) includes a drive link (not shown in FIGS. 2-6) that is located internal of the housing and that is operatively connected to move the drop chute(s) 62 through the rotating disc assembly 84.

Figure 7:
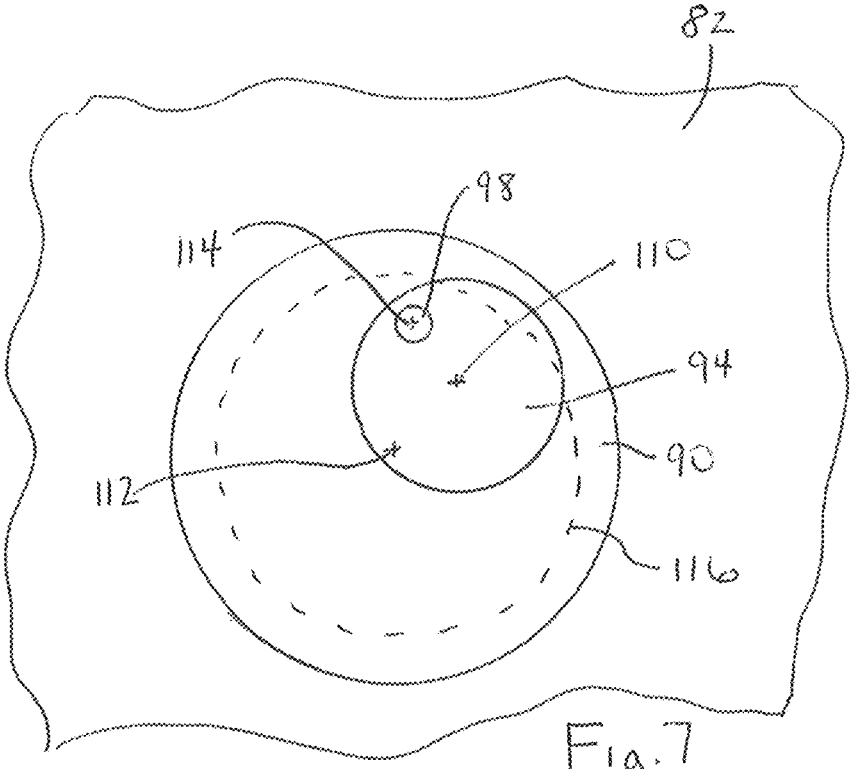
FIG. 7 is a schematic depiction of a rotating disc assembly of the machine housing.

The rotating disc assembly includes a primary disc 90 rotatably and sealingly engaged in the opening 86 of the housing wall 82. The primary disc 90 includes an opening 92 therein, and a secondary disc 94 is rotatably and sealingly engaged in the opening 92. The secondary disc 94 includes an opening 96 therein, and an external drive link 98 is rotatably and sealingly engaged in the opening 96. The external drive link 98 includes a free end 100 that is connected (e.g., via a fastener 102) to a mount bracket 104 attached at the bottom of the beam 70. Here, axis 110 is the center axis of the opening 92 and the secondary disc 94, axis 112 is the center axis of the opening 86 and the primary disc 90, and axis 114 is the center axis of the opening 96 and the link 98. Notably, the center axis 110 is offset from the center axis 112, and the center axis 114 is offset from the center axis 112. With this arrangement, by the combined relative rotation of the secondary disc 94 within the opening of the primary disc 90 and the relative rotation of the primary disc 90 within the opening of the housing wall 82, the axis of the link 98 can be positioned anywhere within the area represented by dashed line circle 116, as per FIG. 7. In this way, the vertical movement and horizontal movement of the drive link 98 is transferred through the wall 82 while maintaining a sealed condition of the internal space of the machine housing.

Figure 8:
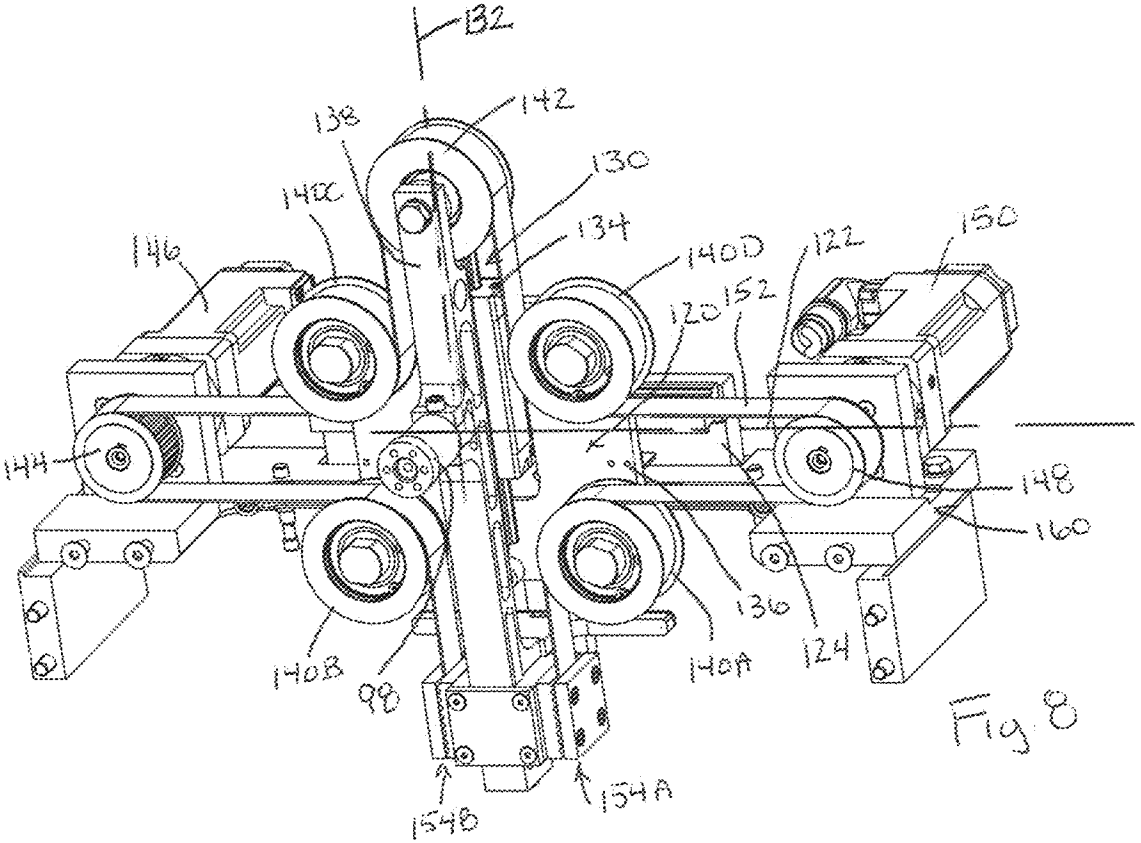
FIGS. 8 and 9 are perspective views of a drive assembly of the machine.
Figure 9:
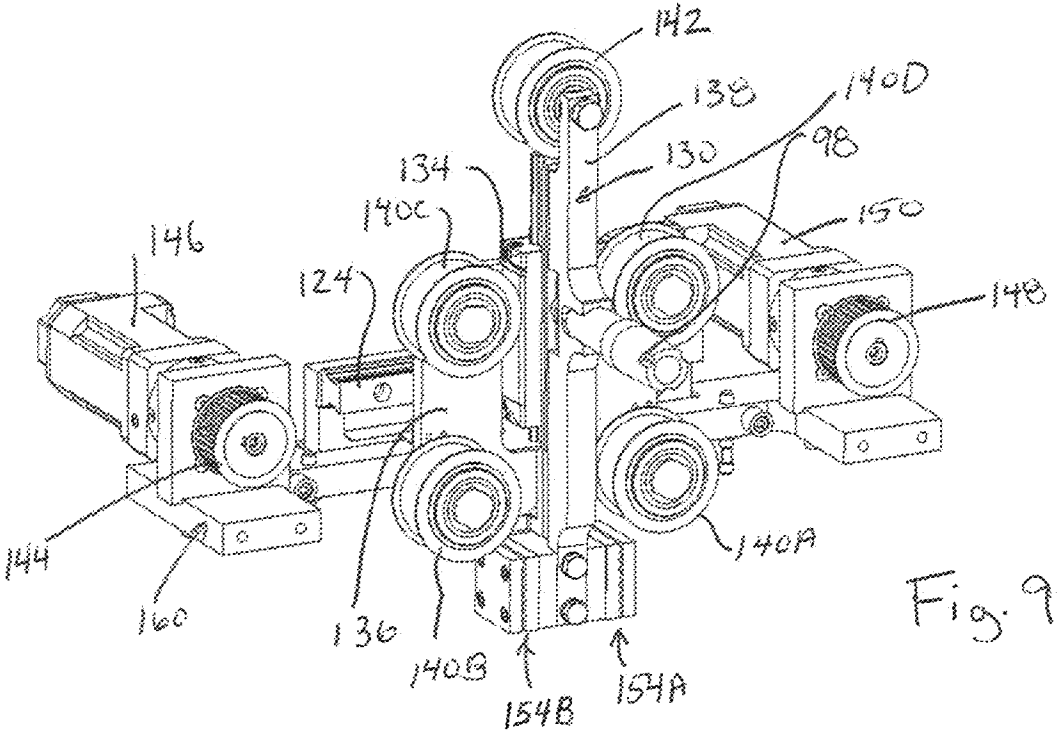

With respect to the drive train that is used to control the vertical and horizontal movement of the drive link 98, such movement is achieved using a unique 2-axis gantry assembly (or T-bot gantry). In particular, referring to FIGS. 8 and 9, a primary drive frame 120 is laterally movable along a lateral axis 122, which may be defined by a slide rail 124 to which the primary drive frame 120 is mounted. A secondary drive frame 130 is mounted on the primary drive frame 120 for lateral movement therewith. The secondary drive frame 130 is also mounted for movement relative to the primary drive frame 120 along a vertical axis 132, which may be defined by a slide rail 134 that is fixed to a plate 136 of the primary drive frame. Here, the axes 122 and 132 are perpendicular to each other, though other transverse axis arrangements or possible. The secondary drive frame 130 includes and carries the drive link 98 (i.e., the drive link 98 moves in the same manner as a slide bar 138 of the secondary drive frame).

Figure 10A:
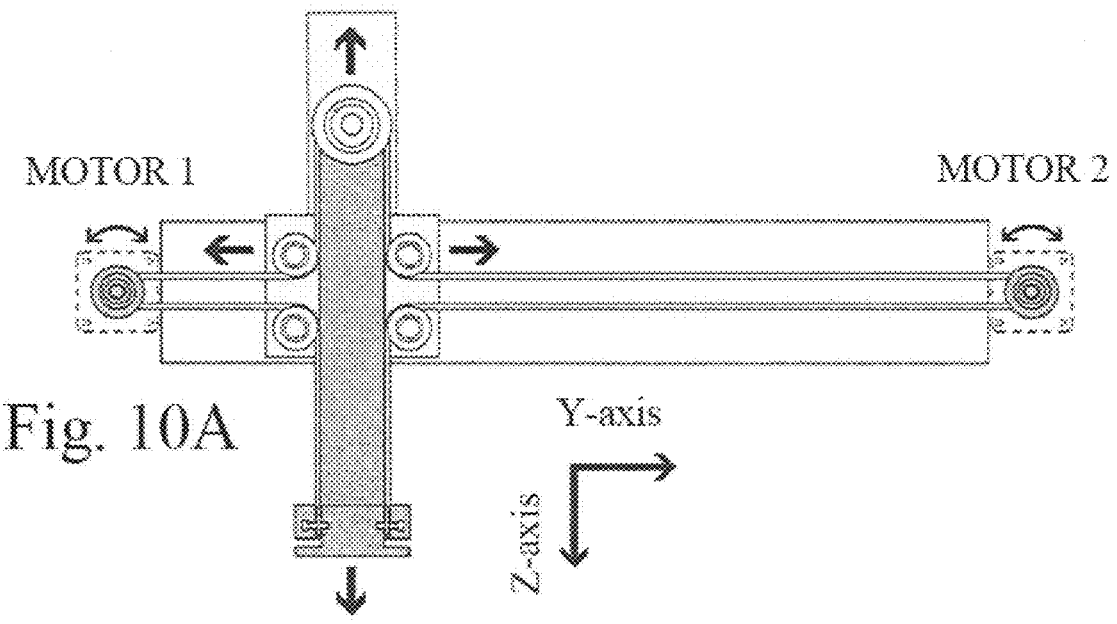
FIG. 10A is a front schematic depiction of the drive assembly.
Figure 10B:
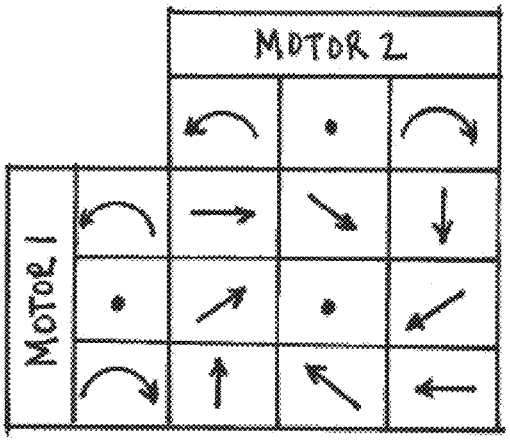
FIG. 10B is a table showing movement achieved based upon motor control variations.

The plate 136 carries non-toothed rotatable pulleys 140A-140D, and the slide bar 138 carries a non-toothed rotatable pulley 142. A toothed drive pulley 144 is driven by a motor 146 (e.g., servomotor) and a toothed drive pulley 148 is driven by a motor 150 (e.g., servomotor). A toothed belt 152 traverses a path that extends partially around each of the pulleys 140B, 144, 140C, 142, 140D, 148 and 140A. The belt 152 is fixed at a lower end of the slide bar 138 (e.g., free ends of the belt may be held in clamp plate assemblies 154A and 154B). The positions of the pulley/motor pairs 144, 146 and 148, 150 are fixed. Here, the pulley/motor pairs are mounted at opposite ends of a support plate 160, and the support plate 160 also supports the slide rail 124 to which the primary frame 120 is slidingly mounted. With this arrangement, the position of the drive link 94 can be moved any of (i) laterally only (by moving the primary frame 120 along the slide rail, (ii) vertically only (by moving the secondary frame along the slide rail 134) or (iii) both laterally and vertically simultaneously. The schematic depictions in FIGS. 10A and 10B demonstrate how such motions can be achieved by independent control of the motors 146 and 150, as explained more fully below.

Each motor 146, 150 can be operates to maintain its associated toothed pulley stationary and to rotate its toothed pulley in either rotational direction (counterclockwise or clockwise). Rotation of both the pulleys 144 and 148 in in the counterclockwise direction causes the drive link to move laterally in one direction (here left to right, as viewed in FIG. 8) without any vertical movement of the drive link. Rotation of both the pulleys 144 and 148 in the clockwise direction causes the drive link to move laterally in the other direction (here right to left, as viewed in FIG. 8) without any vertical movement of the drive link. Rotation of the pulley 144 counterclockwise while the pulley 148 is stationary causes the drive link to simultaneously move in the left to right lateral direction and downward. Rotation of the pulley 144 clockwise while the pulley 148 is stationary causes the drive link to simultaneously move in the right to left lateral direction and upward. Rotation of the pulley 148 counterclockwise while the pulley 144 is stationary causes the drive link to simultaneously move in the left to right lateral direction and upward. Rotation of the pulley 148 clockwise while the pulley 144 is stationary causes the drive link to simultaneously move in the right to left lateral direction and downward. Rotation of the pulley 144 counterclockwise while the pulley 148 is rotated clockwise causes the drive link to move downward without any lateral movement. Rotation of the pulley 144 clockwise while the pulley 148 is rotated counterclockwise causes the drive link to move upward without any lateral movement. The relative vertical and lateral movement of the drive link can be controlled by controlling the relative speed of the two motors 146 and 148, thereby enabling movement of the drive link in any linear direction or along any curved path that within the circle 116 shown in FIG. 7.

Figure 11:
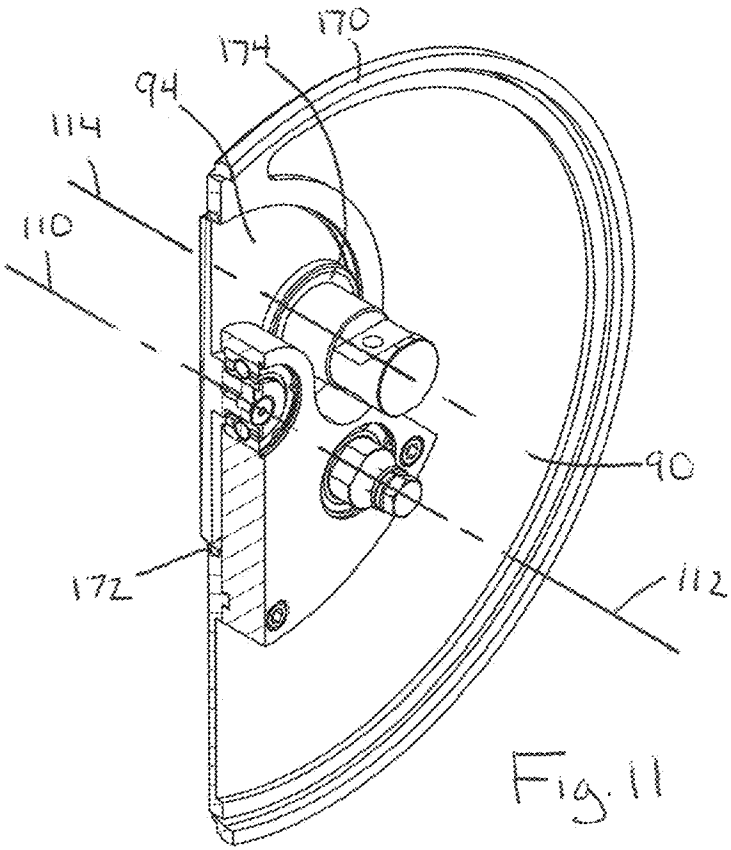
FIGS. 11 and 12 are cross-sections of the rotating disc assembly.
Figure 12:
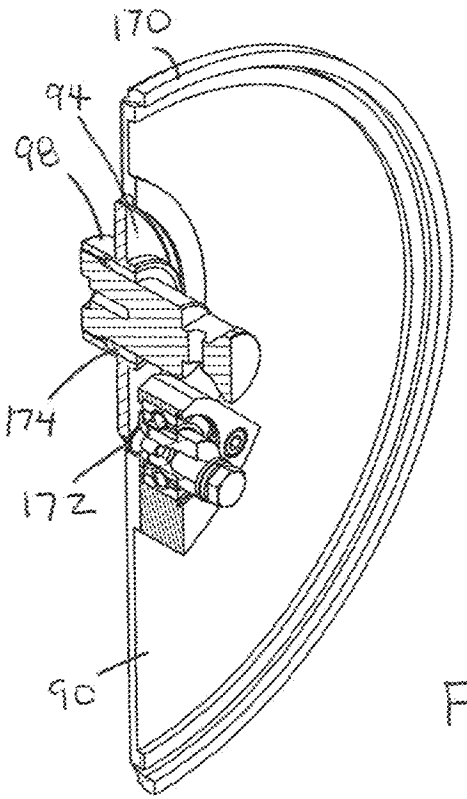
Figure 13:
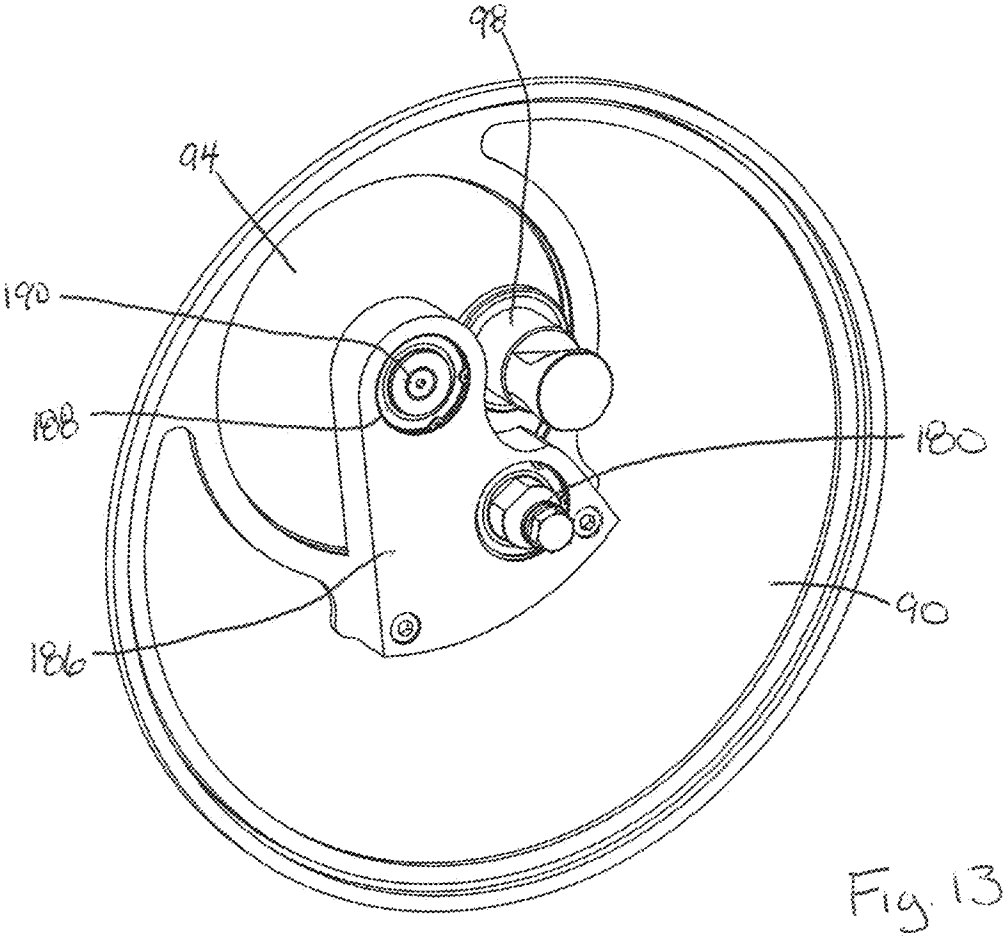
FIG. 13 is a rear perspective of the rotating disc assembly.
Figure 14:
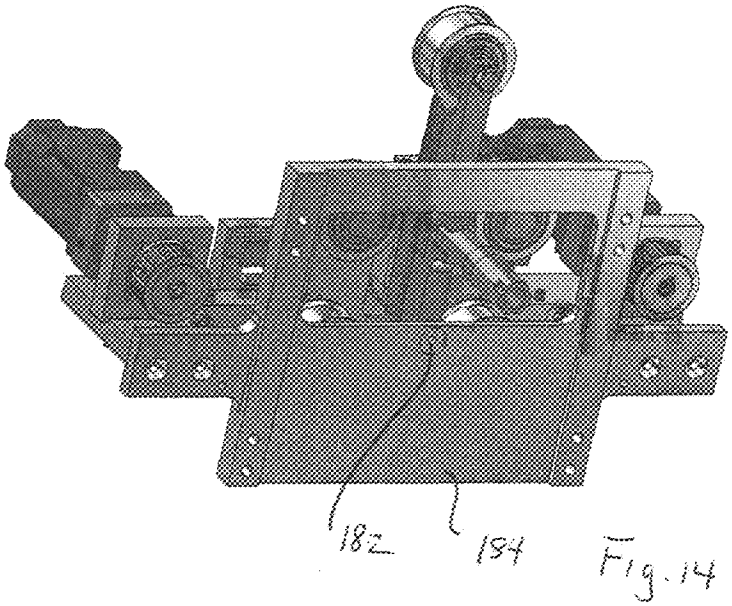
FIG. 14 is a perspective view of the drive assembly and a mount plate for the rotating disc assembly.

As mentioned above, the rotating disc assembly provides a sealed housing structure. In this regard, FIGS. 11 and 12 show annular seal members 170, 172 and 174. Seal member 170, for the primary disc 90, may be attached to the housing opening. Seal member 172 may be attached to the opening of the primary disc, and seal member 174 may be attached to the opening of the secondary disc. A primary support shaft 180 (FIG. 13) may be used to connect the primary disc 90 to an opening 182 in a fixed plate 184 (FIG. 14) internal of the machine housing. The shaft also supports a bracket 186 that in turn defines a connection opening 188 for a support shaft 190 for the secondary disc 94.

Figure 15A:
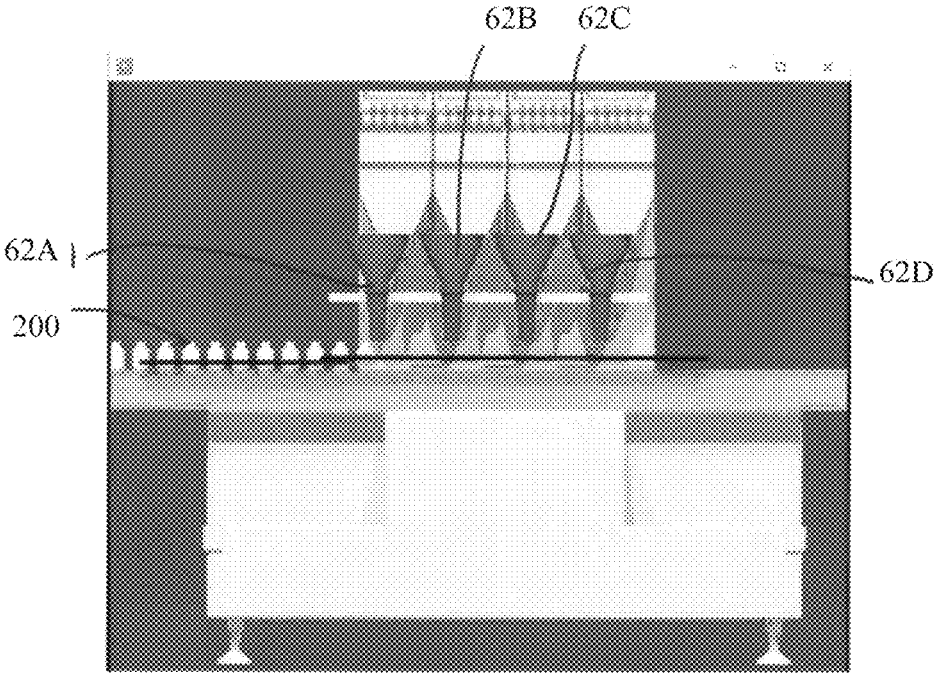
Figure 15B:
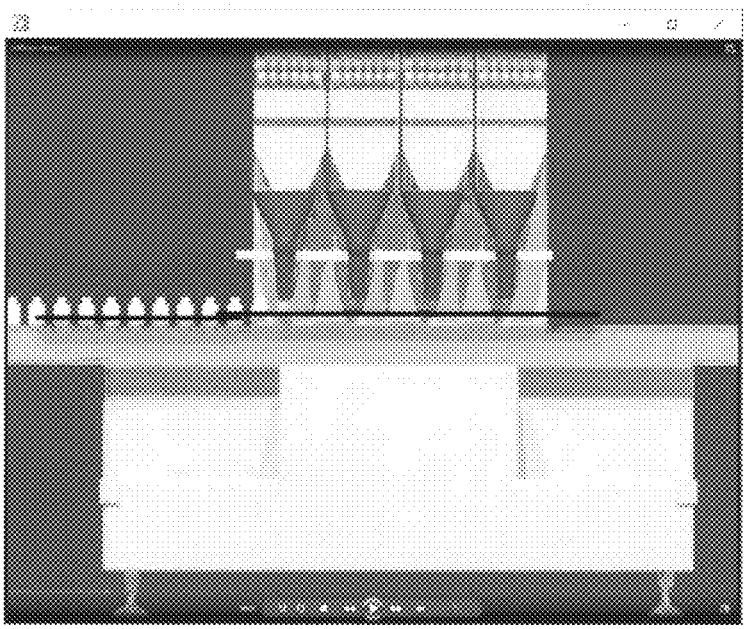
Figure 15C:
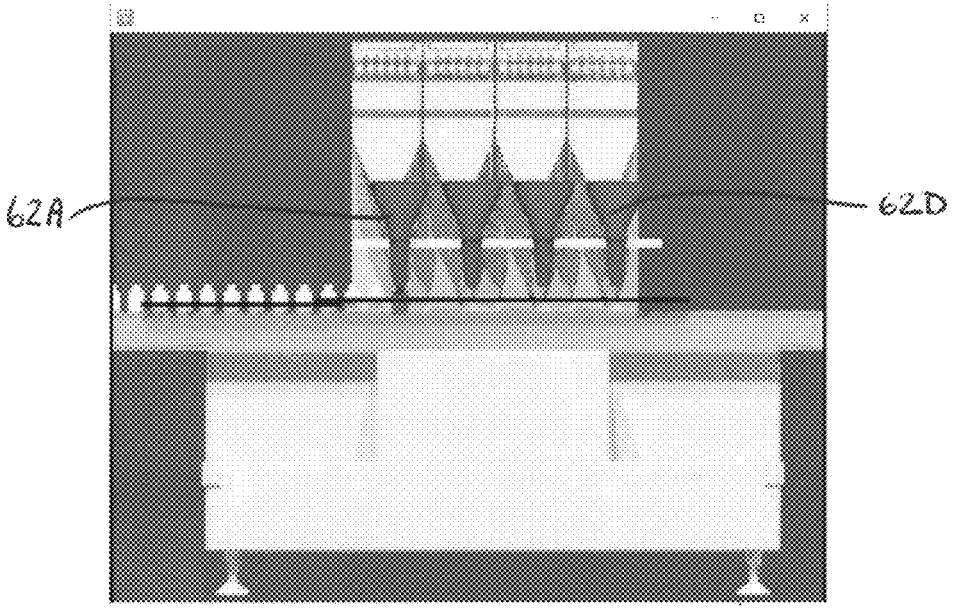
Figure 15D:
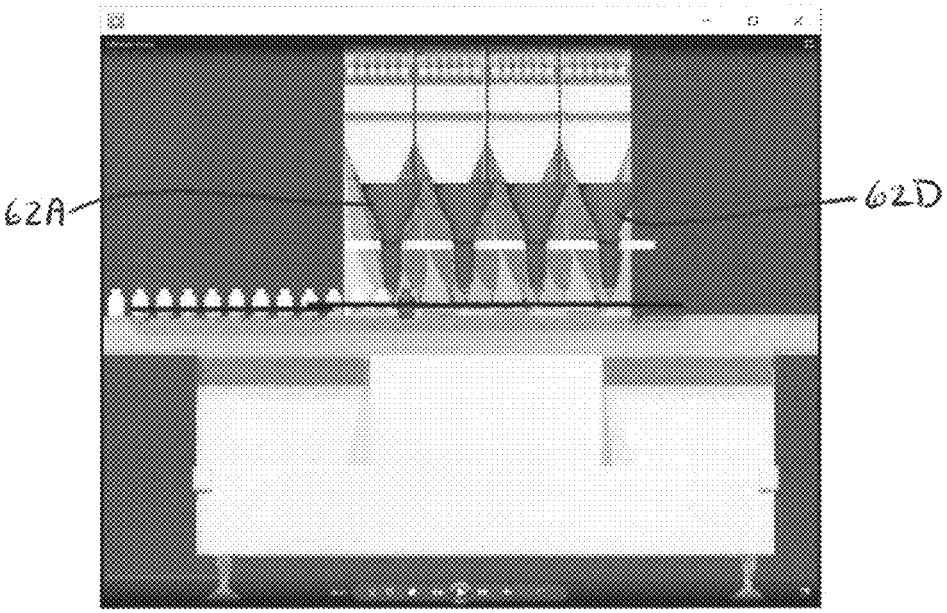
Figure 15E:
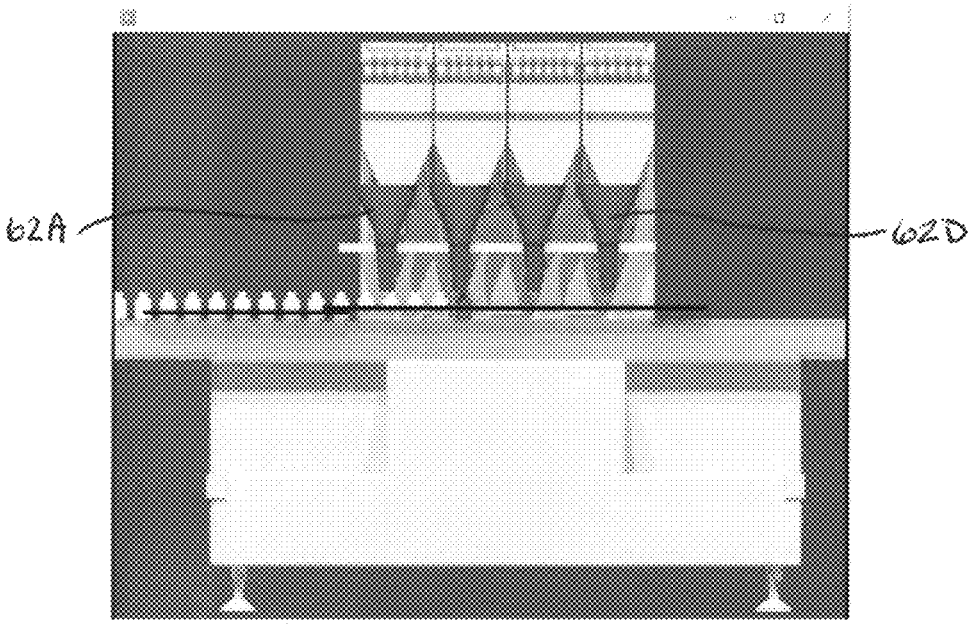
Figure 15F:
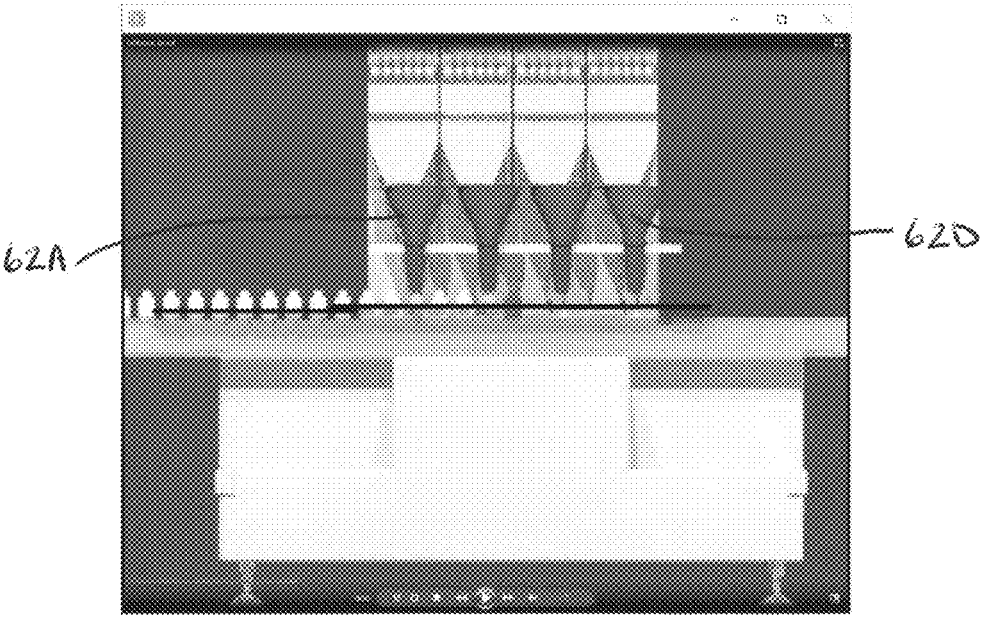
Figure 15G:
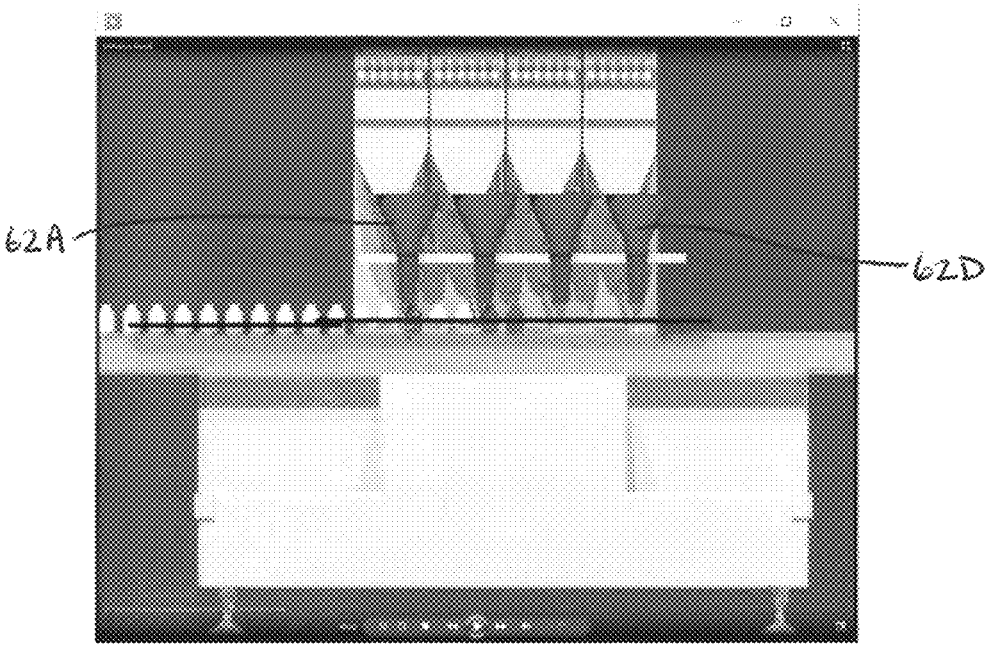
Figure 15H:
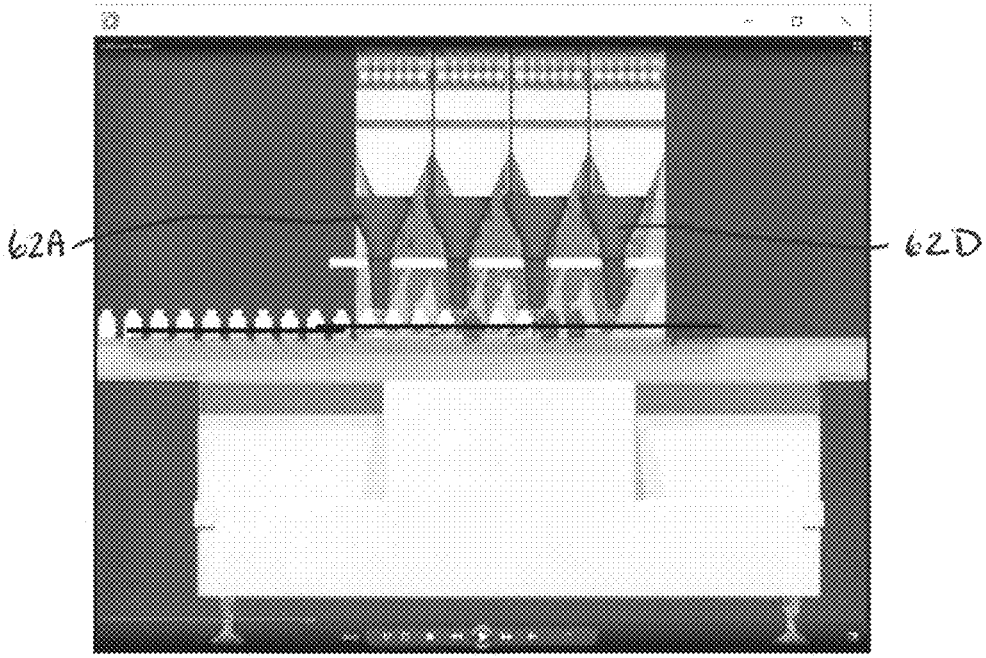
Figure 15I:
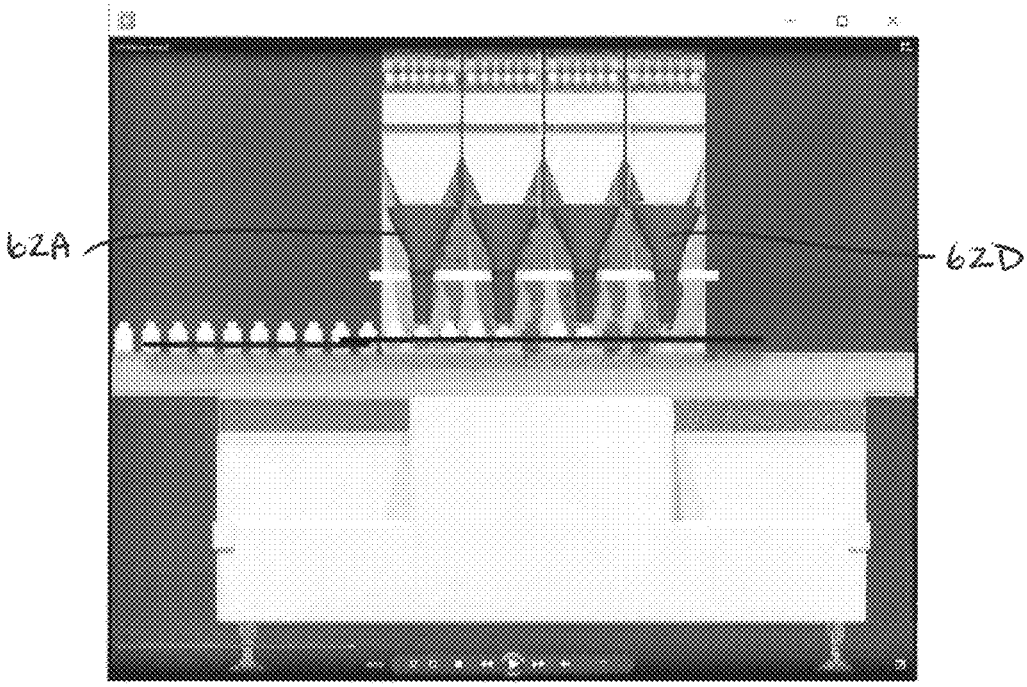
Figure 15J:
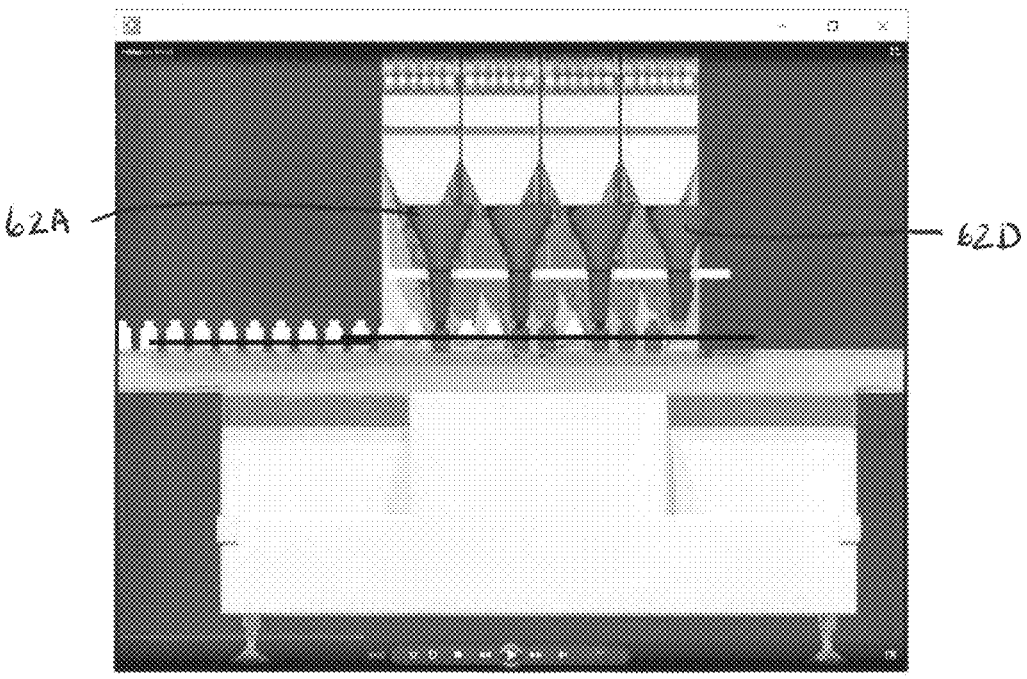
Figure 15K:
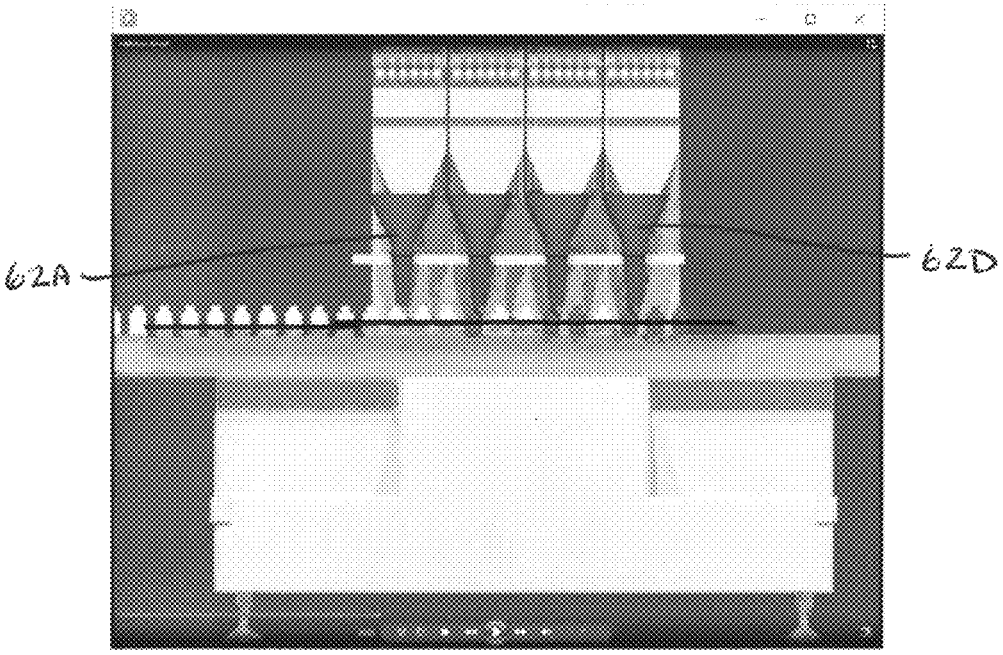
Figure 15L:
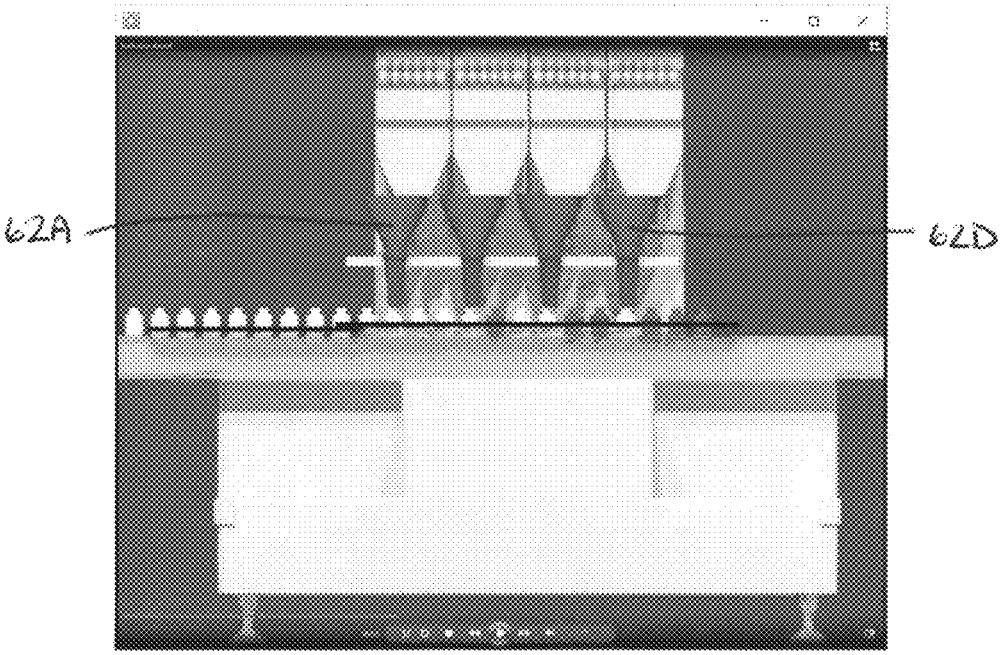
Figure 15M:
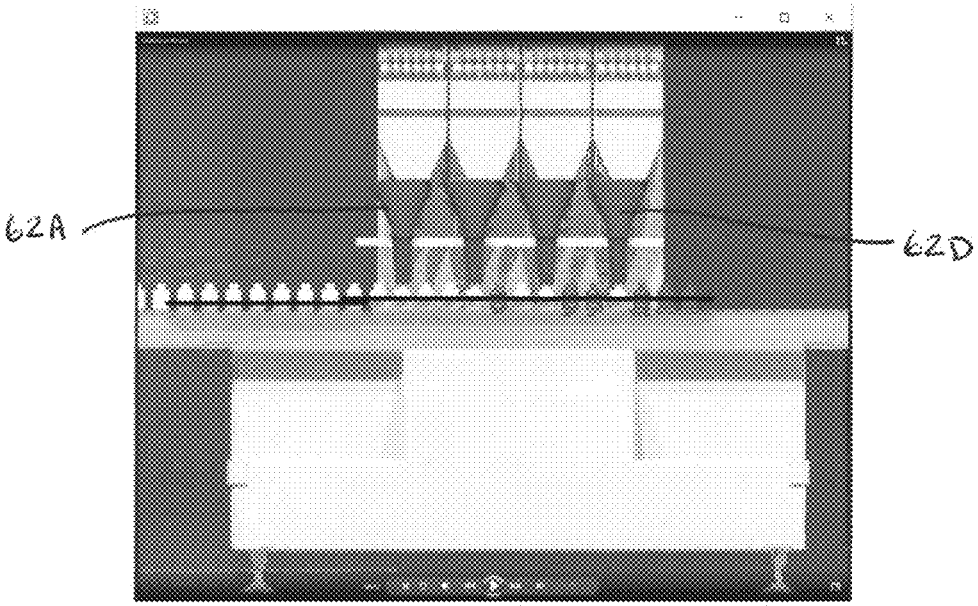
Figure 15N:
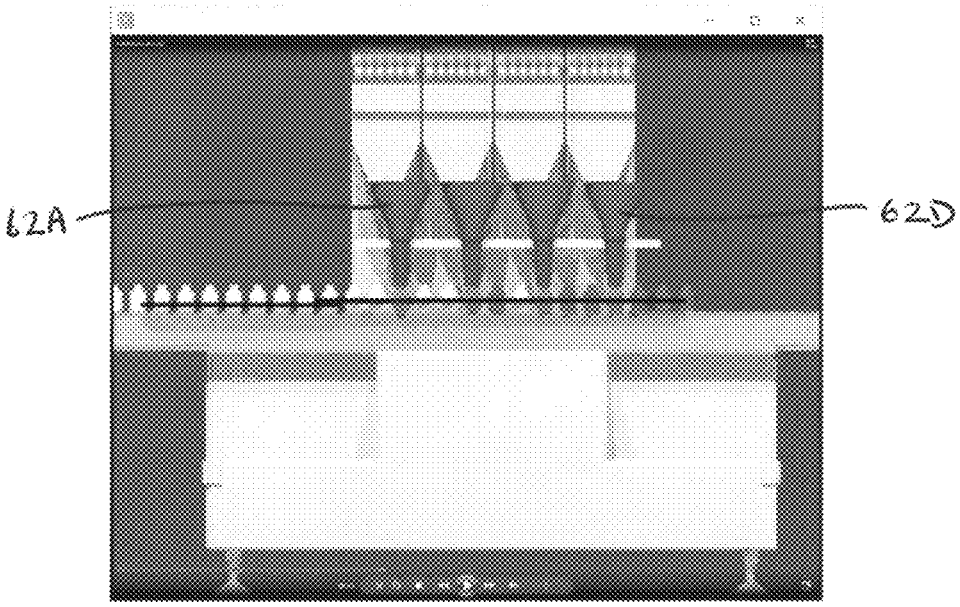
Figure 15O:
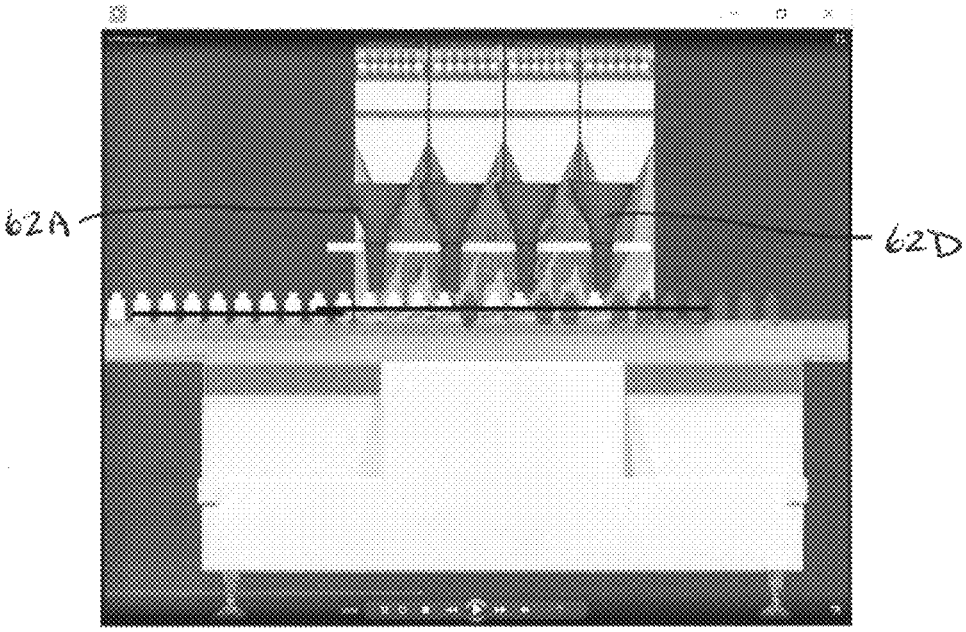
Figure 15P:
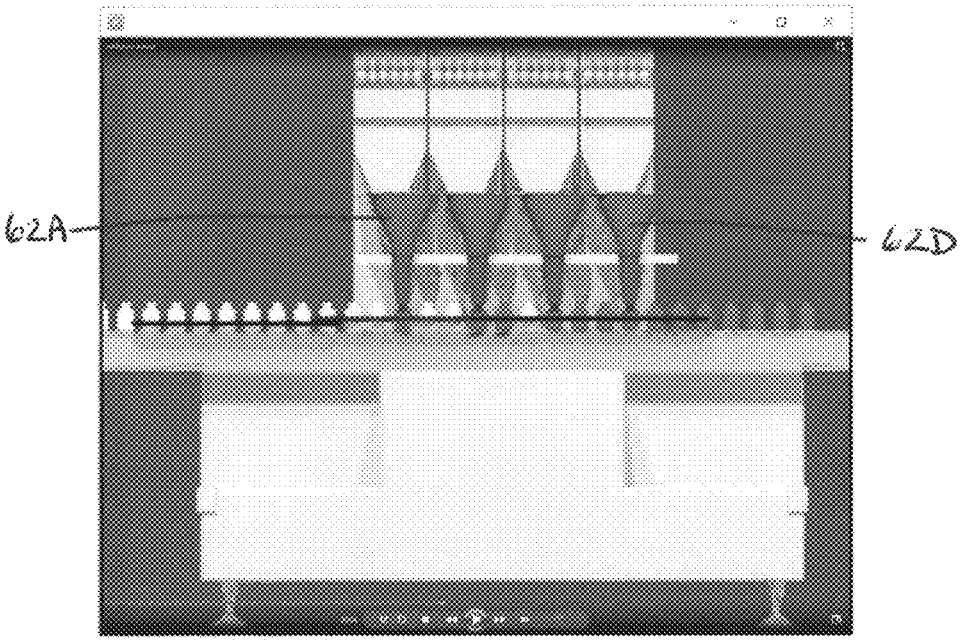

FIGS. 15A-15P show one exemplary movement sequence for the drop chutes 62A-62D (here the machine has four chutes) as containers 200 are continuously conveyed below the drop chutes (here in a left to right lateral direction). In summary, the chutes begin at a leftmost position (FIG. 15A), with chute outlets spaced above the plane in which the top openings of the containers lie. The chutes accelerate in a left to right direction until the chute speed matches the container speed, with the outlet of chute 62A aligned over the container inlet opening, and the chutes move downward so that the outlet of chute 62A engages the initial container and the container is filled with a desired count of items (FIGS. 15B-15C). The chutes are raised and then move laterally right to left back to an initial position (FIGS. 15D-15E) and are then accelerated laterally left to right so that chute 62B aligns with the second container and chute 62A aligns with the fifth container, at which points the chutes move down for filling those two containers (FIG. 15F) and the chutes can then be raised and moved laterally right to left to the initial position. Acceleration left to right for speed matching and then downward movement of the chutes enables the third, sixth and ninth containers to be filled (FIGS. 15G-15J). Similar sequencing continues/repeats to fill the fourth, seventh, tenth and thirteenth containers (FIGS. 15K-15N) and to fill the eighth, eleventh, fourteenth and seventeenth containers (FIGS. 150-15P) and so on.

Figure 16:
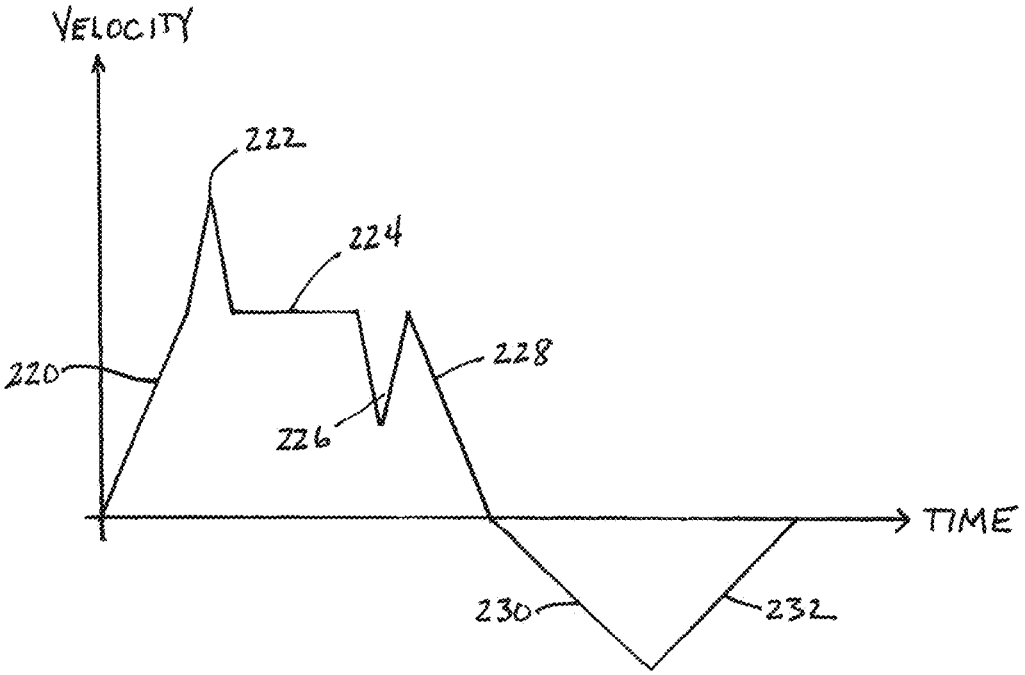
FIG. 16 shows an exemplary motion profile graph for drop chutes of the filling machine.

FIG. 16 shows an exemplary velocity movement profile for the chutes, where the profile above the horizontal axis represents the chute movement during left to right movement to fill, and the profile below the horizontal axis represents chute movement during right to left return indexing. Profile segment 220 represents the left to right acceleration to match container speed, upward peak segment 222 represents movement into engagement with the container, segment 224 represents movement while engaged and filling, downward peak segment 226 represents movement out of engagement with the container, segment 228 represents left to right deceleration, segment 230 represents right to left acceleration and segment 232 represents right to left deceleration.

Figure 17:
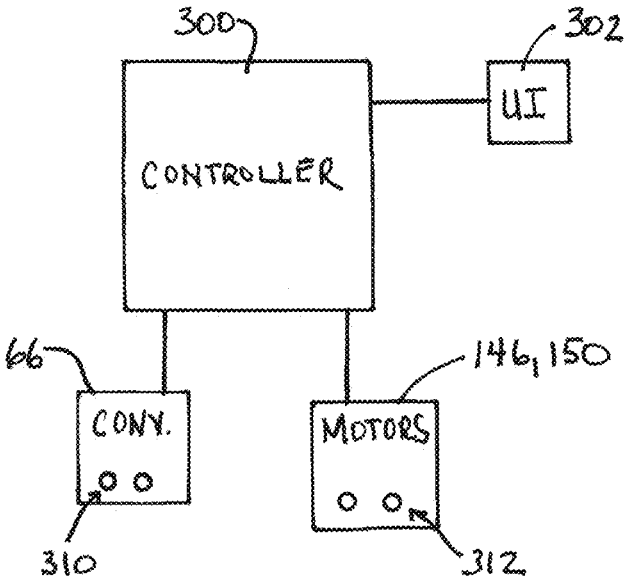
FIG. 17 is a high-level control schematic of the filling machine.

As seen in the schematic of FIG. 17, a controller 300 may be configured to control the movement of both the conveyor and the chute drive system in order to achieve the desired movement profile. The controller may monitor sensor(s) 310, 312 associated with the conveyor and/or motors (e.g., container sensors, motor speed sensors) to help assure proper movement of the chutes relative to the containers. The controller may use torque feedback from one or both servomotors 146, 150 to determine when the chute opening engages with the container. A user interface 302 may be provided to enable adjustment of the profile and/or varying the sequence of fill. For example, the fill sequence for filling containers by the chutes could vary widely (e.g., single chute filling every sequential container; or two chutes filling every two sequential containers, with lateral chute spacing matching the spacing between conveyors; or three chutes, four chutes or five chutes used to fill containers or various possible sizes in various sequences). The machine can be pre-programmed with a plurality of sequences that are selectable based upon bottle diameter and the number of filling locations (e.g., number of drop chutes). The various sequences can be defined to reduce as much as possible the indexing time by making a constant index for the filling operations.

As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the device/machine or the control functions of any component thereof.

It is to be clearly understood that the above description is intended by way of illustration and example only, is not intended to be taken by way of limitation, and that other changes and modifications are possible. For example, while the description above focuses on the use of pulleys and a belt in the drive train, a chain with corresponding sprockets could be used as an alternative to the pulleys and belt. Still other modifications are possible.

What is claimed is:

1. A filling system, comprising:

a conveyor for moving containers to be filled along a conveyance path;

at least one drop chute with an outlet above the conveyance path;

a drive assembly operatively connected for moving the drop chute to align the outlet of the drop chute with one container of the moving containers during filling of the one container with items, the drive assembly comprising:

a primary drive frame movable along a first axis;

a secondary drive frame mounted on the primary drive frame for movement therewith, the secondary drive frame movable relative to the primary drive frame along a second axis, wherein the second axis is transverse to the first axis, wherein the secondary drive frame includes a drive link operatively linked to move the drop chute;

wherein the drive assembly further includes a drive system for selectively controlling whether: (i) the primary drive frame moves along the first axis while the secondary drive frame does not move along the second axis, (ii) the secondary drive frame moves along the second axis while the primary drive frame does not move along the first axis and (iii) the primary drive frame moves along the first axis while the secondary drive frame moves along the second axis.

2. The filling system of claim 1, wherein the drive assembly further includes:

a first motor connected to drive a first pulley or sprocket;

a second motor connected to drive a second pulley or sprocket;

a common belt or chain traversing a path that runs partially around the first pulley or sprocket and partially around the second pulley or sprocket, wherein the common belt or chain extends along a belt or chain path associated with both the primary drive frame and the secondary drive frame.

3. The filling system of claim 2, wherein the drive assembly includes a first rail that defines the first axis, wherein the primary drive frame is laterally movable along the lateral rail, wherein the primary drive frame includes a second rail that defines the second axis;

wherein the secondary drive frame is movable along the second rail.

4. The filling system of claim 3, wherein the common belt or chain includes opposite ends that have a fixed position on the secondary drive frame.

5. The filling system of claim 4, wherein the first rail is a lateral rail and the second rail is a vertical rail;

wherein the first motor is operable to (i) maintain the first pulley or sprocket stationary, (ii) rotate the first pulley or sprocket in a first rotational direction or (iii) rotate the second pulley or sprocket in a second rotational direction, which is opposite the first direction;

wherein the second motor is operable to (i) maintain the second pulley or sprocket stationary, (ii) rotate the second pulley or sprocket in the first rotational direction or (iii) rotate the second pulley or sprocket in the second rotational direction;

wherein rotation of both the first pulley or sprocket and the second pulley or sprocket in the first rotational direction causes the drive link to move in a first lateral direction without any vertical movement of the drive link;

wherein rotation of both the first pulley or sprocket and the second pulley or sprocket in the second rotational direction causes the drive link to move in a second lateral direction without any vertical movement of the drive link, wherein the second lateral direction is opposite the first lateral direction;

wherein rotation of the first pulley or sprocket in the first rotational direction while the second pulley or sprocket is stationary causes the drive link to simultaneously move in the first lateral direction and in a first vertical direction;

wherein rotation of the first pulley or sprocket in the second rotational direction while the second pulley or sprocket is stationary causes the drive link to simultaneously move in the second lateral direction and in a second vertical direction, which is opposite the first vertical direction;

wherein rotation of the second pulley or sprocket in the first rotational direction while the first pulley or sprocket is stationary causes the drive link to simultaneously move in the first lateral direction and in the second vertical direction;

wherein rotation of the second pulley or sprocket in the second rotational direction while the first pulley or sprocket is stationary causes the drive link to simultaneously move in the second lateral direction and in the first vertical direction;

wherein rotation of the first pulley or sprocket in the first rotational direction while the second pulley or sprocket is rotated in the second rotational direction causes the drive link to move in the first vertical direction without any lateral movement of the drive link;

wherein rotation of the first pulley or sprocket in the second rotational direction while the second pulley or sprocket is rotated in the first rotational direction causes the drive link to move in the second vertical direction without any lateral movement of the drive link.

6. The filling system of claim 4, further comprising:

a controller operatively connected to control the conveyor and the drive assembly, the controller configured to operate the drive assembly to synchronize movement of the drop chute with movement of the one container during filling of the one container with items as the one container continues to move.

7. The filling system of claim 6, wherein the controller is configured operate the drive assembly to move the drop chute laterally to maintain alignment with the one container and to move the drop chute vertically down into contact with the one container as items are filled into the one container.

8. The filling system of claim 7, wherein the controller is configured to monitor a torque level of at least one of the first motor or the second motor to identify when the drop chute is in contact with the one container.

9. The filling system of claim 1, wherein a position of the second axis along the first axis moves with the primary drive frame along the first axis, and a position of the first axis along the second axis remains fixed during movement of the secondary drive frame along the second axis.

10. The filling system of claim 9, wherein the first axis is oriented substantially parallel to horizontal and the second axis is oriented substantially parallel to vertical.

11. A filling machine, including the filling system of claim 2, wherein:

the filling machine includes a housing that encloses an internal space, the housing including a rotating disc assembly positioned in an opening of a housing wall;

wherein the primary drive frame, the secondary drive frame, the first motor, the first pulley or sprocket, the second motor, the second pulley or sprocket, and the common belt or chain are all located within the internal space;

wherein the drop chute is located external of the housing outside the internal space;

wherein the drive link is operatively connected to move the drop chute through the rotating disc assembly.

12. The filling machine of claim 11, wherein the rotating disc assembly includes a primary disc rotatably and sealingly engaged in the opening of the housing wall, the primary disc including an opening therein, and a secondary disc rotatably and sealingly engaged in the opening of the primary disc.

13. The filling machine of claim 12, wherein the secondary disc includes an opening therein, wherein the drive link is rotatably and sealingly engaged in the opening of the secondary disc, and the drive link is operatively connected to move the drop chute.

14. The filling machine of claim 13, wherein a center axis of the opening in the primary disc is offset from a center axis of the primary disc, wherein a center axis of the opening in the secondary disc is offset from a center axis of the secondary disc.

15. The filling machine of claim 13, wherein the drive link is operatively connected to a laterally extending beam, and the beam is operatively connected to the drop chute.

16. The filling machine of claim 13, wherein a center axis of the opening in the primary disc is offset from a center axis of the primary disc, wherein a center axis of the opening in the secondary disc is offset from a center axis of the secondary disc.

17. A filling machine, comprising:

a housing at least in part defining an internal space, the housing including a rotating disc assembly positioned in an opening of a housing wall;

a conveyor for moving containers to be filled along a conveyance path at an external side of the housing;

at least one drop chute with an outlet above the conveyance path;

a drive assembly operatively connected for moving the drop chute to align the outlet of the drop chute with one container of the moving containers during filling of the one container with items, the drive assembly including a drive link movable both substantially parallel to the conveyance path and runs substantially perpendicular to the conveyance path, at least part of the drive link located within the internal space;

wherein the drive link is operatively connected to move the drop chute through the rotating disc assembly;

wherein the rotating disc assembly includes a primary disc rotatably engaged in the opening of the housing wall, the primary disc including an opening therein, and a secondary disc rotatably engaged in the opening of the primary disc.

18. The filling machine of claim 17, wherein the secondary disc includes an opening therein, wherein the drive link is rotatably engaged in the opening of the secondary disc, and the drive link is operatively connected to move the drop chute.

19. The filling machine of claim 18, wherein drive link is operatively connected to a laterally extending beam, and the beam is operatively connected to the drop chute.

20. The filling machine of claim 18, wherein a center axis of the opening in the primary disc is offset from a center axis of the secondary disc, and a center axis of the opening in the secondary disc is offset from a center axis of the secondary disc.

21. The filling machine of claim 18, wherein the internal space is a sealed space, the primary disc is rotatably and sealingly engaged in the opening of the housing wall, the secondary disc is rotatably and sealingly engaged in the opening of the primary disc, and the drive link is rotatably and sealingly engaged in the opening of the secondary disc.

22. The filling machine of claim 7, wherein internal space is a sealed space, the primary disc is rotatably and sealingly engaged in the opening of the housing wall, the secondary disc is rotatably and sealingly engaged in the opening of the primary disc.

23. A filling system, comprising:

a conveyor for moving containers to be filled along a conveyance path;

at least one drop chute with an outlet above the conveyance path;

a drive assembly operatively connected for moving the drop chute to align the outlet of the drop chute with one container of the moving containers during filling of the one container with items, the drive assembly comprising:

a primary drive frame movable along a first axis;

a secondary drive frame mounted on the primary drive frame for movement therewith, the secondary drive frame movable relative to the primary drive frame along a second axis, wherein the second axis is transverse to the first axis, wherein the secondary drive frame includes a drive link operatively linked to move the drop chute;

wherein a position of the second axis moves along the first axis as a result the primary drive frame moving along the first axis, and a position of the first axis along the second axis remains fixed during movement of the secondary drive frame along the second axis.

* * * * *